US005901971A

United States Patent [19]

Eaton

[11] Patent Number: 5,901,971

[45] Date of Patent: May 11, 1999

[54] STEP-IN/STEP-OUT BOOT MOUNTS FOR SNOWBOARDS

[76] Inventor: Eric L. Eaton, 6646 S. Prospect, Tacoma, Wash. 98409

[21] Appl. No.: 08/798,769

[22] Filed: Feb. 11, 1997

[51] Int. Cl.[6] ..... A63C 9/24

[52] U.S. Cl. ..... 280/14.2; 280/616; 280/624; 280/634

[58] Field of Search ..... 280/14.2, 616, 280/617, 618, 624, 634

[56] References Cited

U.S. PATENT DOCUMENTS

| | | | |
|---|---|---|---|
| 5,249,377 | 10/1993 | Walkhoff | 36/119 |
| 5,354,088 | 10/1994 | Vetter et al. | 280/14.2 |
| 5,556,123 | 9/1996 | Fournier | 280/607 |
| 5,577,755 | 11/1996 | Metzger et al. | 280/14.2 |
| 5,690,350 | 11/1997 | Turner et al. | 280/613 |
| 5,727,797 | 3/1998 | Bowles | 280/617 |

*Primary Examiner*—Lanna Mai
*Assistant Examiner*—Michael Cuff
*Attorney, Agent, or Firm*—Delbert J. Barnard

[57] ABSTRACT

A snowboard boot that is provided with a downwardly projecting ratchet bar (30) at its rear. A boot binding (18) on a snowboard (10) includes a toe strap (50) for receiving the toe region of the boot (28). The snowboard rider steps into the boot holder (18) by inserting the toe region of his/her boot (28) through the toe strap (50) when it is a loosened condition. Then the rider steps down to move the ratchet bar (30) into and through a receptor (38) that is secured to a heel region member (24) of the boot holder (18). Downward movement of the ratchet bar (30) moves ratchet teeth (22) relatively past a tooth engaging portion of a catch (36). When the boot has bottomed out, the tooth engaging portion of the catch (36) engages a tooth (32) of the ratchet bar (30) and secures the heel region of the boot (28) to the snowboard (10). Then, the rider reaches down and tightens the toe strap (50).

22 Claims, 5 Drawing Sheets

STEP-IN/STEP-OUT BOOT MOUNTS FOR SNOWBOARDS

TECHNICAL FIELD

This invention relates to snowboards. More particularly, it relates to the provision of a step-in/step-out type snowboard boot mount for a snowboard, characterized primarily by a ratchet-type connection between the heel region of the snowboard boot and the heel region of a snowboard boot holder on the snowboard.

BACKGROUND OF THE INVENTION

U.S. Pat. No. 5,354,088, granted Oct. 11, 1994, to Dennis A. Vetter and Eric L. Eaton discusses snowboards, their use on ski slopes, the need for the snowboard rider to have one leg free for use to push himself/herself forward on the snowboard, and the problems encountered when mounting and dismounting a chair on a chair lift. The invention of U.S. Pat. No. 5,354,088 provides a step-in/step-out rear foot mount for a snowboard. Such invention is characterized by a detachable connection between a snowboard boot holder and the snowboard. The present invention provides a step-in/step-out mount between the snowboard boot and the snowboard boot holder.

Application Ser. No. 08/609,287, filed Mar. 1, 1996, by Eric L. Eaton and John C. Bitow, relates to front foot mounts for snowboards which allow the rider to rotate or pivot his/her front foot in position on the snowboard. It also relates to such snowboards which are provided with a step-in/step-out type rear foot mount. The present invention is usable with such a snowboard. The step-in/step-out foot mount of the present invention can be used with the rotatable or pivotal front foot mount in Ser. No. 08/609,287. It can be used with such a mount for both the front foot and the rear foot. Accordingly, Application Ser. No. 08/609,287 is hereby incorporated into this application by this specific reference.

The step-in/step-out snowboard boot holder of the present invention could also be used with the apparatus disclosed in U.S. Pat. No. 5,354,088 for adjusting the angular position of a boot mount on the snowboard.

DISCLOSURE OF THE INVENTION

The present invention is basically characterized by apparatus for detachably connecting a boot to a snowboard comprising first and second connector components, one of which is connected to of the boot and the other of which is connected to the snowboard. The first connector component includes a generally vertically oriented ratchet bar having a series of generally vertically spaced apart ratchet teeth. The second connector component includes a receptor for the ratchet bar. The receptor includes a releasable ratchet tooth engaging catch that allows movement of the ratchet bar relatively into the receptor in response to a downward movement of the boot. The receptor has a first position in which the catch engages a ratchet tooth on the ratchet bar to restrain movement of the ratchet bar out from the receptor and movement of the boot away from the snowboard. The receptor has a second position in which the catch is out of engagement with the ratchet bar and the ratchet bar is movable out from the receptor in response to movement of the boot upwardly away from the snowboard.

In first preferred form, the first connector component, the ratchet bar, is connected to the heel region of the boot. The second connector component, the receptor for the ratchet bar, is connected to the snowboard. However, the invention also includes the reverse of this arrangement. In second preferred form, the ratchet bar is connected to the snowboard and the receptor is connected to the heel region of the snowboard boot.

According to an aspect of the invention, the snowboard includes a toe strap that is adapted to extend over a toe portion of the snowboard boot, to bind the toe portion of the boot to the snowboard. With the toe strap loosened, the snowboard rider places his/her boot into the boot holder, toe first, and then steps down to move the ratchet bar relatively into the ratchet bar receptor. The tooth engaging catch of the receptor moves relatively along the series of ratchet teeth until the boot has achieved a bottom position in the boot holder. At that time, the catch will engage a tooth and hold the rear portion of the snowboard boot in place within the snowboard boot holder. Then, the toe strap can be tightened so as to bind the toe portion of the snowboard boot to the snowboard.

A particular advantageous feature of the invention is that the snowboard boot will be securely bound to the snowboard even if snow is initially between the bottom of the boot and the floor of the boot holder. In such case, the boot will bottom out on the snow and will be held to the snowboard by engagement of the catch with a tooth on the ratchet bar. As the snow is either dislodged or melts, the boot will move further downwardly and the catch will automatically engage another tooth on the ratchet bar.

According to another aspect of the invention, the snowboard boot holder is connected to the snowboard for pivotal movement about a vertical axis and is selectively lockable into a plurality of azimuthal positions on the snowboard.

These and other advantages, objects and features will become apparent from the following best mode description, the accompanying drawings, and the claims, which are all incorporated herein as part of the disclosure of the invention.

BRIEF DESCRIPTION OF THE DRAWINGS

Like reference numerals are used to designate like parts throughout the several views of the drawing, and.

BEST MODE FOR CARRYING OUT THE INVENTION

Figure 1:
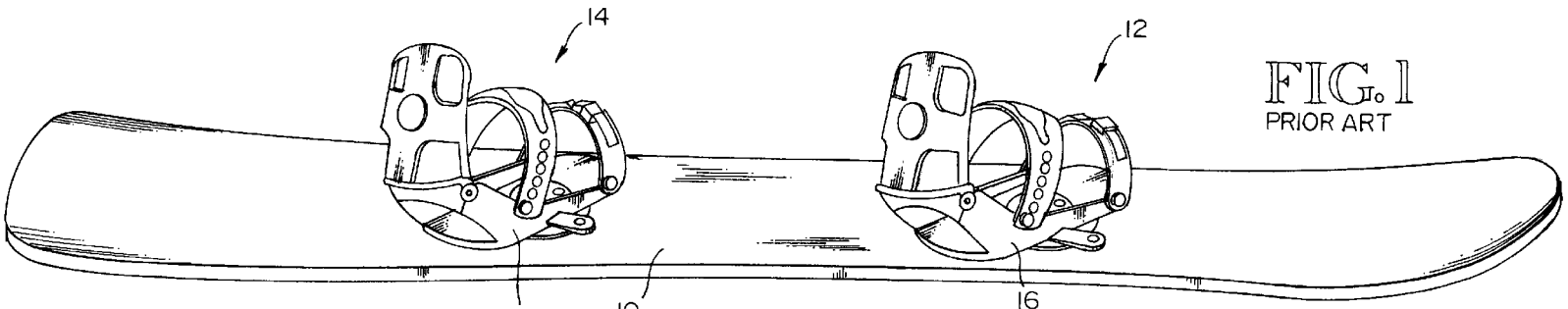
FIG. 1 PRIOR ART
FIG. 1 is a pictorial view taken from above and looking down towards the top and one side of a snowboard, such view showing two boot holders or bindings spaced longitudinally apart on the snowboard, one for receiving a boot on the front foot of a rider and the other for receiving a boot on the rear foot of the rider.

FIG. 1 shows a snowboard 10 to which a front boot holder 12 and a rear boot holder 14 are attached. The front boot holder 12 is adapted to receive a boot on the front foot of the snowboard rider. In like fashion, the rear boot holder 14 is adapted to receive a boot on the rear foot of the snowboard rider.

Figure 2:
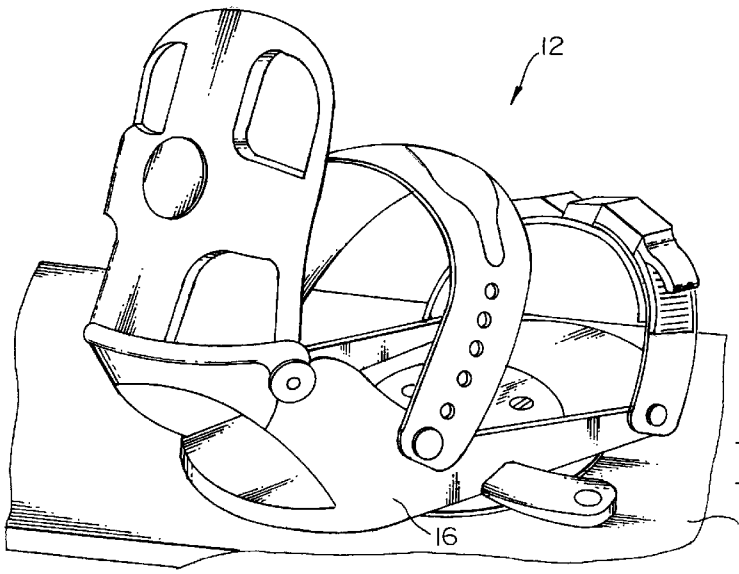
FIG. 2 is an enlarged scale fragmentary view of one of the boot holders shown in FIG. 1.

FIGS. 1 and 2 illustrate a system that is disclosed in the aforementioned copending application Ser. No. 08/609,287. In such system, the front boot holder 12 is suitably secured to the snowboard 10 for rotation in position azimuthally about a vertical axis, at least from a position directly laterally to one side of the board, around the front end of the board, to a position directed laterally towards the opposite side of the board. The rear boot holder 14 also has a plurality of azimuthal positions. However, it is mounted for a step-out release from the snowboard 10. That is, the boot and boot holder 14 are releasable from the snowboard 10.

According to the present invention, there is a step-in engagement and a step-out disengagement of the boot relative to the boot holder. According to the present invention, both boot holders may be constructed in the manner that is hereinafter described. The mechanism for mounting the boot holder to the snowboard for angular adjustment about a vertical axis, and the mechanism for locking the boot holder in a selected azimuthal position, may be like the structure disclosed in application Ser. No. 08/609,287. The step-in/step-out feature of the present invention may also be used with the boot holder disclosed in the aforementioned U.S. Pat. No. 5,354,088. That is, the boot holder may be adjustable in position on the snowboard, in the manner disclosed in U.S. Pat. No. 5,354,088. At the same time, the boot may be engageable with and removable from the boot holder by use of the present invention.

Figure 3:
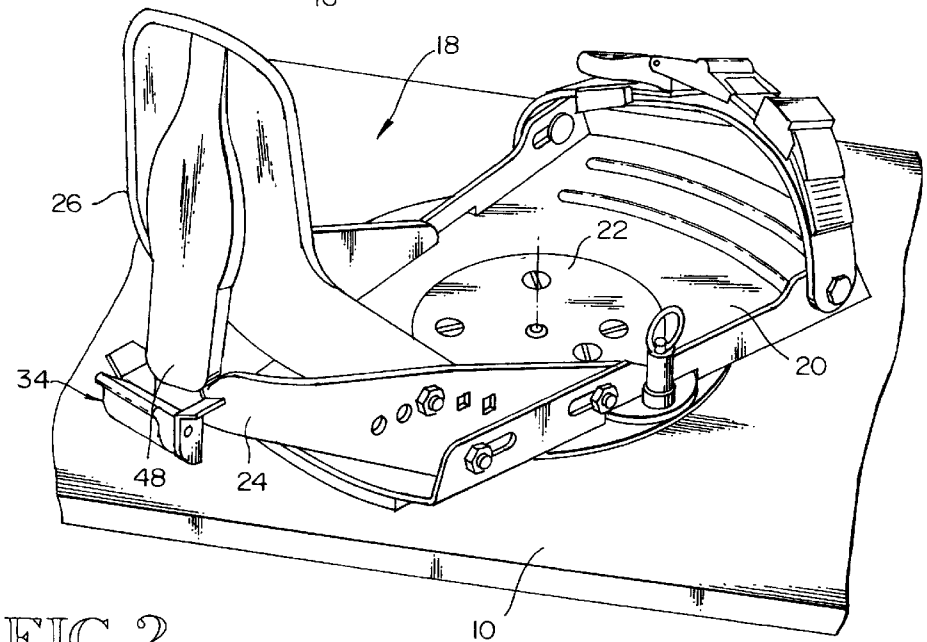
FIG. 3 PRIOR ART
FIG. 3 is a view like FIG. 2, but of a modified boot holder that incorporates the present invention.

Referring to FIG. 3, the boot holder 18 of the present invention may comprise a bottom section 20 that is mounted on the snowboard 10 for rotation about a vertical axis 22. Section 20 is preferably made from metal and includes a metal rear portion 24 that extends behind the heel region of the boot (not shown). Boot holder 18 may include a rear support 26 that extends upwardly from portion 22.

According to the present invention, the heel region of the boot 28 (FIGS. 4 and 5) is connected to the heel region of the holder 18 by a two-component connector, one of which is connected to the heel region of the boot and the other which is connected to the snowboard. In preferred form, the snowboard component is connected to the heel region of the boot holder 18. According to the invention, the first connector component includes a generally vertically oriented ratchet bar 30 having a series of generally vertically spaced apart ratchet teeth 32. The second connector component includes a receptor 34 for the ratchet bar 30, including a releasable ratchet tooth engaging catch 36 that is constructed to allow movement of the ratchet bar 30 relatively into the receptor 34, in response to a downward movement of the boot 28, respectively.

Figure 4:
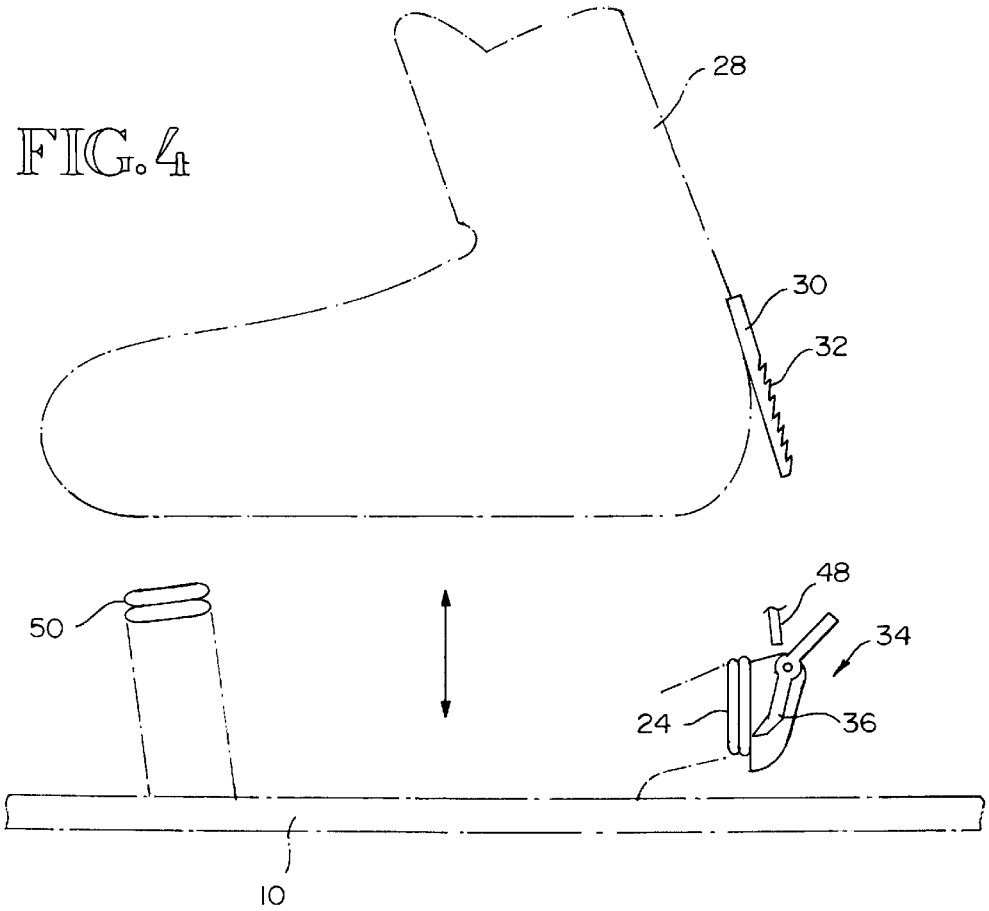
FIG. 4 is a view showing a boot positioned above a snowboard, with the boot shown to include a ratchet bar at its heel region, and with the snowboard shown to include a ratchet bar receptor and a toe strap for the boot.
Figure 5:
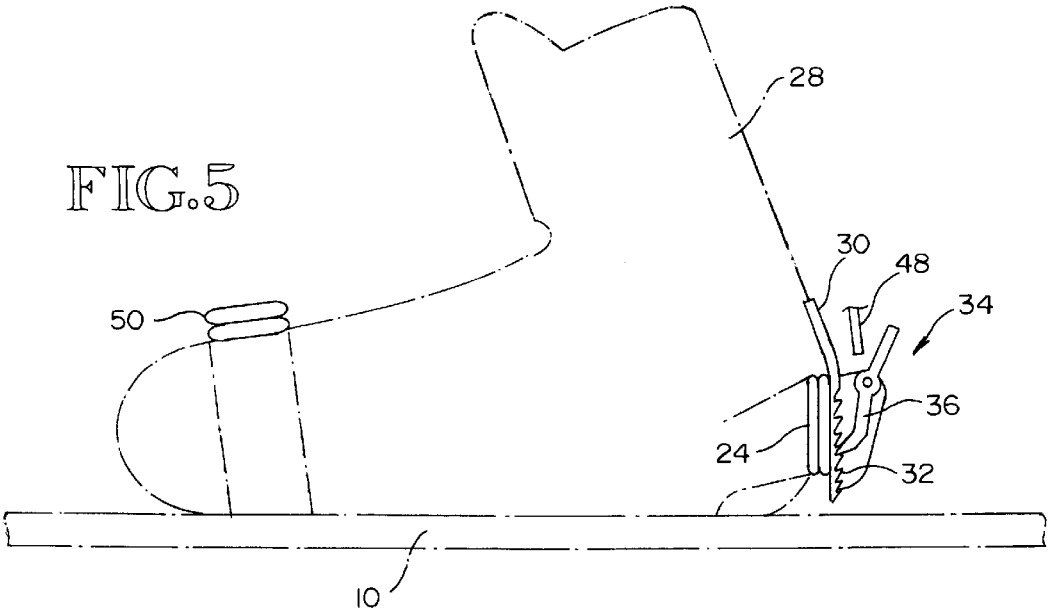
FIG. 5 is a view like FIG. 4 but showing the boot secured to the snowboard, with the ratchet bar within the receptor and the toe strap over the toe region of the boot.
Figure 6:
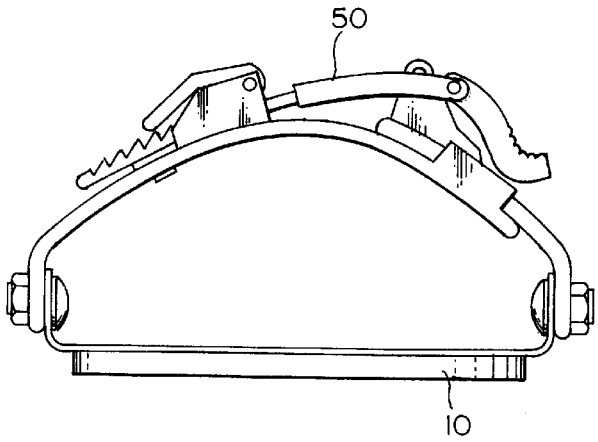
FIG. 6 is a cross-sectional view taken substantially along line 6—6 of FIG. 5, showing the toe strap extending over the toe region of the boot.
Figure 7:
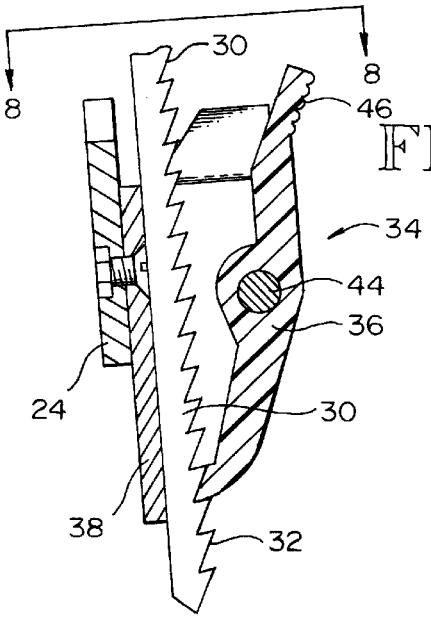
FIG. 7 is an enlarged scale fragmentary view of the ratchet bar and the ratchet bar receptor, showing a catch portion of the receptor engaging a tooth of the ratchet bar.

The receptor has a first position, shown by solid lines in FIG. 7, in which the catch 36 engages a ratchet tooth 32 on the ratchet bar 30 and restrains movement of the ratchet bar 30 out from the receptor 34. It also restrains movement of the boot 28 away from the snowboard 10. The receptor 34 has a second position, shown by broken lines in FIG. 7, in which the catch 36 is out of engagement with the ratchet bar 30. This allows the ratchet bar 30 to be moved out from the receptor 34 in response to movement of the boot 30 upwardly away from the snowboard 10. In preferred form, the rear support 26 of the boot holder 18, sometimes referred to as a "high back," is positioned and shaped to guide the ratchet bar 30 into the receptor 34. In FIGS. 3–5, a portion of the ratchet bar guide is designated 48.

In a first preferred embodiment, the first connector component, the ratchet bar 30, is connected to the heel region of the boot 28. The second connector component, the receptor 34, is connected to the snowboard 10. By way of example, receptor 34 may be connected to the heel region of member 24, as shown in FIGS. 3–5. Of course, it is to be understood that the positions of the two connector components can be reversed. That is, the receptor 34 can be mounted on the boot 28 and the ratchet bar 30 can be mounted on the snowboard 10.

Figure 8:
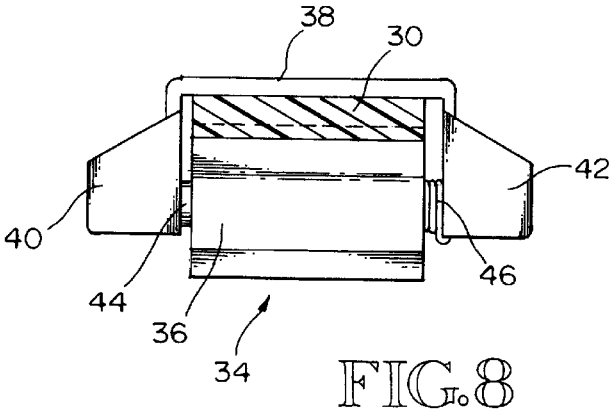
FIG. 8 is a sectional view taken substantially along line 8—8 of FIG. 7, with the ratchet bar shown in cross-section and the receptor shown in top plan.
Figure 9:
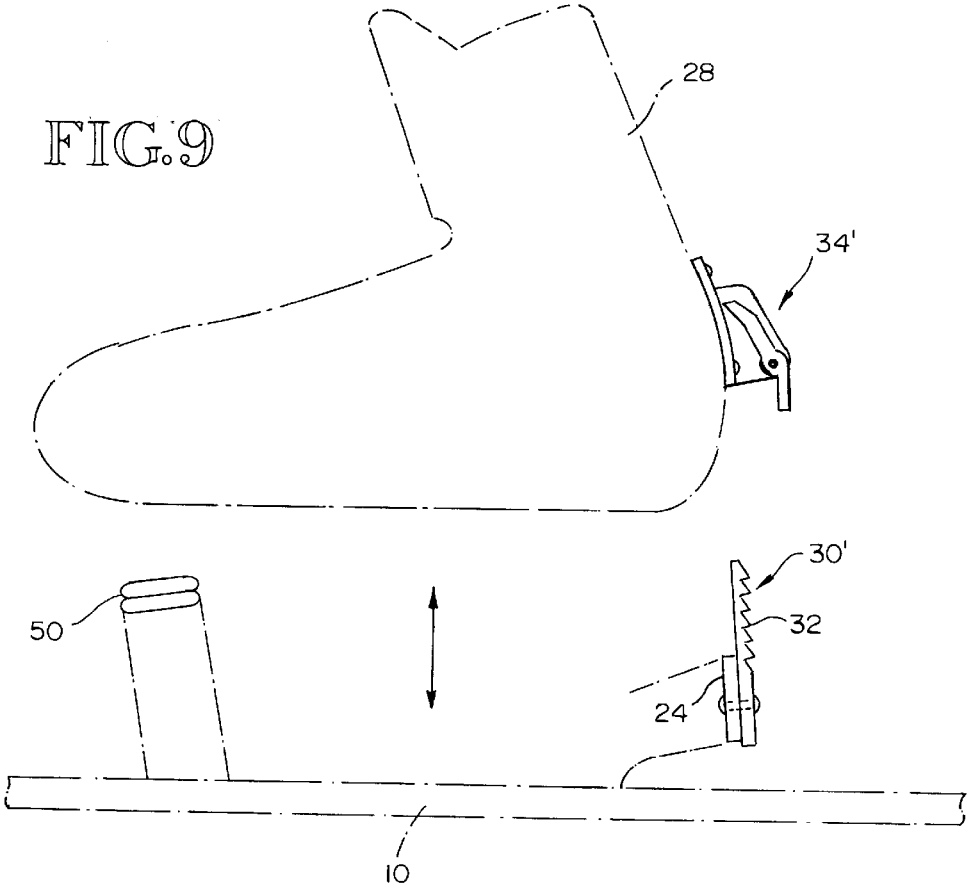
FIG. 9 is a view like FIG. 4, but showing the ratchet bar connected to the boot holder and the ratchet bar receptor connected to the boot.
Figure 10:
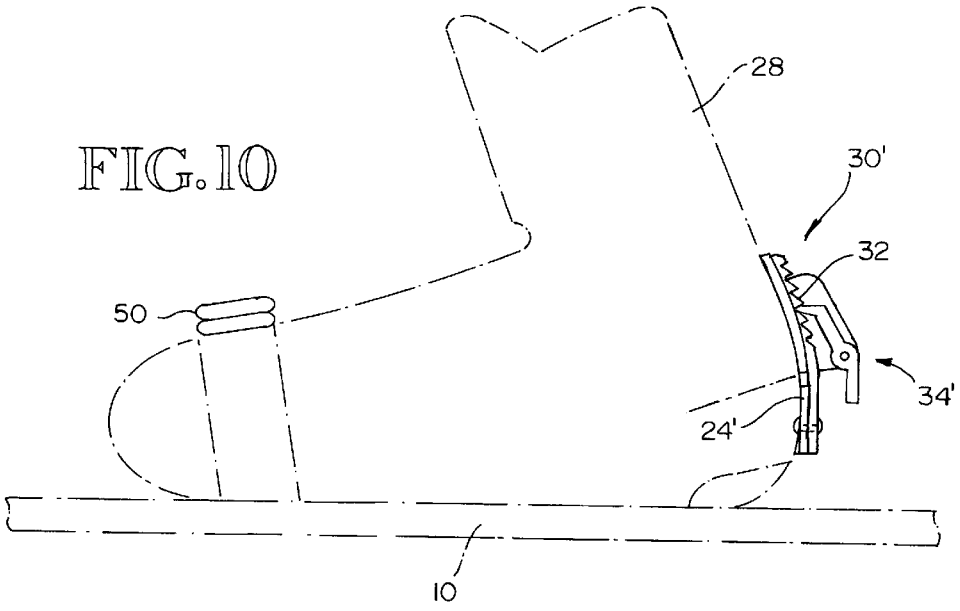
FIG. 10 is a view like FIG. 5, but showing the ratchet bar connected to the boot holder and the ratchet bar receptor connected to the boot.

Referring to FIGS. 7 and 8, the receptor 34 may comprise a generally U-shaped frame having a back wall 38 and parallel sidewalls 40, 42 which project perpendicular from back wall 38. Catch 36 may have a lower end portion which engages the teeth 32 of the ratchet bar 30. Intermediate its ends, the catch 36 may be secured to the side walls 40, 42 by a pivot pin 44. Catch 36 may include an upper handle portion 46 situated above pin 42. In a manner known per se, the catch 36 is provided with a torsion spring that is connected to both the catch 36 and a stationary part of the receptor frame. This spring biases the tooth engaging lower end portion of the catch 36 towards the back wall 38. As will be evident from an inspection of FIG. 7, as the ratchet bar 30 moves downwardly relatively through the receptor 34, contact between the ratchet teeth 32 and the lower end portion of the catch 36 will rotate the catch 36 in position, allowing the ratchet bar 30 to move relatively through the receptor 34. As in any ratchet, the teeth push against the catch and allow a tooth-by-tooth movement of the ratchet bar past the tooth engaging portion of the catch 34. In the case of the present invention, when the ratchet bar 30 is on the boot, the snowboard rider places his/her boot in the binding, toe first, and in the process steps down to move the ratchet bar 30 downwardly into the receptor 34. When the boot achieves a bottom position within the boot holder 18, further downward movement of both the boot 28 and the ratchet bar 30 are prevented. Also, the lower end portion of catch 36 has moved into engagement with a tooth, e.g. 32 in FIG. 7. This engagement locks the ratchet bar 30 to the receptor and in that manner secures the boot 28 to the boot holder. Unless the catch is released, the heel region of the boot is restrained against upward movement out from the boot holder.

When the rider inserts his/her boot 28 into the boot holder 18, there may be snow on the bottom of the boot and/or on the floor of the boot holder. Initially, the boot 28 will bottom out with this snow packed between the boot 28 and the floor of the boot holder 18. The boot 28 will be secured to the boot holder 18 by engagement of the catch 36 with a tooth 32 on ratchet bar 30. A benefit of the present invention is that as the snow either melts or is dislodged from between the boot 28 and the boot holder 18, the ratchet bar 30 will move downwardly further into the receptor 34 and the catch 36 will engage another of the teeth 32. In this manner, there is an automatic adjustment of the rear connector.

Referring again to FIG. 7, when it is desired for the rider to remove his/her boot 28 from the boot holder 18, he/she only has to reach down and pull up on the upper end 46 of the catch 36. This rotates the catch 36 in position and moves its lower end out of engagement with the teeth of the ratchet bar 30. It is moved into the broken line position shown in FIG. 7. Then, the rider need only lift his/her foot to move the boot out from the boot holder. Any tendency of the rear portion of the boot to move out from the boot holder is resisted by the engagement of catch 36 with a tooth 32 on the ratchet bar 30. This puts the ratchet bar 30 in tension and it is capable of withstanding large tension forces. The upper end of the ratchet bar 30 can be riveted to a reinforced back wall portion of the boot 28. Or, ratchet bar 30 can be bound to the boot by a harness. Preferably, the boot 28 is a "soft boot" as opposed to a "hard boot." As known in the art, a "soft boot" has a soft or relatively pliable shell, whereas a "hard boot" has a hard or relatively rigid shell. Examples of "soft boots" are shown on pages 184–187 of the 1997 Buyer's Guide, Vol. 5, Issue 1, No. 12, published by SnowBoard Canada Magazine, of 2255B Queen Street East, #3266, Toronto, Ontario, M4E IG3, Canada. An example harness is shown on page 25 of this Buyer's Guide.

Figure 11:
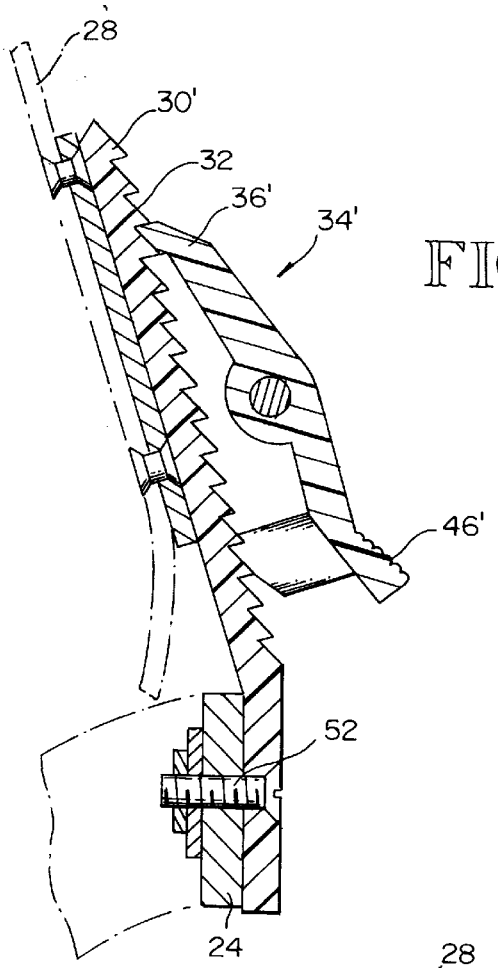
FIG. 11 is a view like FIG. 7, but showing the ratchet bar connected to the boot holder and the ratchet connected to the boot holder and the ratchet bar receptor connected to the boot.
Figure 12:
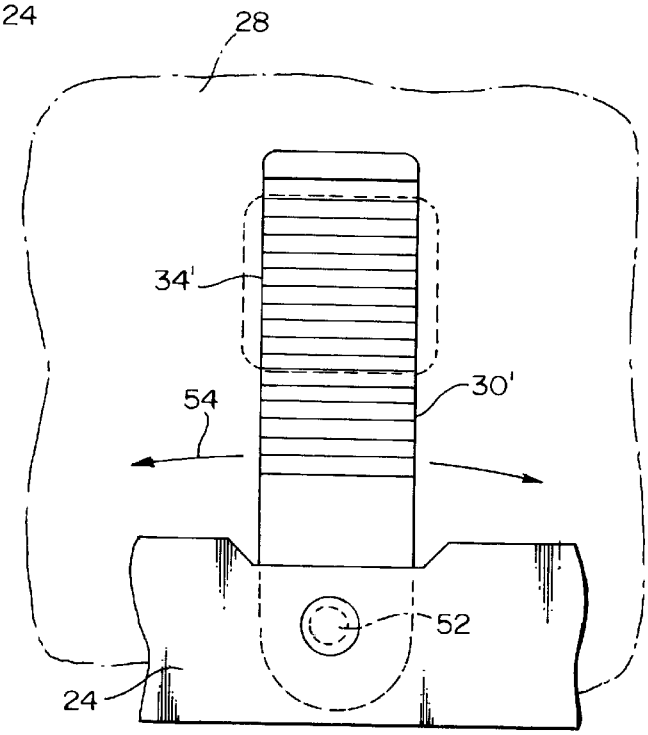
FIG. 12 is a fragmentary rear elevational view looking towards the ratchet bar, such view showing the ratchet bar and a fragmentary portion of the boot holder in solid line, and showing an outline of the ratchet bar receptor and fragmentary portion of the boot in broken line.

FIGS. 9–12 illustrate a second preferred embodiment. In this embodiment, the receptor bar 30' is connected to the boot holder. The receptor 34' is connected to the boot 28. As best shown by FIGS. 11 and 12, ratchet bar 30' may be secured to the rear portion 24 by a single bolt or rivet 52 in a manner that allows the ratchet bar 30' to pivot back and forth in the general direction indicated by arrow 54. The back support 26 of the boot holder, if one is used, may be shaped to guide the receptor 34' into a position where the catch 36' will engage a tooth 32 on the ratchet bar 30'. A lower central portion of back support member 26 may be cut out so that the user can reach down and push against the lever 46', for disengaging the catch 36' from the ratchet bar 30'. The pivotal mounting of the ratchet bar 30' allows a sideways tilt of the boot while the catch 36' is engaged with a tooth 32. Referring to FIG. 12, a sideways tilting of boot 28 will move with it receptor 34'. The moving receptor 34' applies a sideways force on the upper portion of ratchet bar 30'. This causes ratchet bar 30' to pivot about the axis established by the connector 52.

In the first preferred embodiment, the just-described ratchet bar/receptor connector 30, 34 at the rear of the boot 28 is used in combination with a toe strap 50 at the front end of the boot. While other front end connections can be used, the toe strap connection is preferred. A toe strap firmly binds the toe region of the boot to the snowboard. The toe strap 50 is of conventional construction and is adapted to be adjustable in position between a loose position and a tight position. In the loose position, the toe portion of the boot can be readily inserted through the toe strap. In the tightened position, the strap is down relatively tight against the boot and serves to bind the toe region of the boot to the snowboard. Examples of toe straps on bindings are shown on pages 173–178 of the magazines aforementioned SnowBoard Canada magazine's, 1997 Buyer's Guide.

The illustrated embodiments are only examples of the present invention and, therefore, are non-limitive. It is to be understood than many changes in the particular structure, materials and features of the invention may be made without departing from the spirit and scope of the invention. For example, the toe region may be held to the board by any type of connector structure. The receptor or ratchet bar may be located anywhere along the perimeter of the boot. There can be more than one ratchet bar/receptor connection. Therefore, it is my intention that my patent rights not be limited by the particular embodiments illustrated and described herein, but rather determined by the following claims, interpreted according to accepted doctrines of claim interpretation, including use of the doctrine of equivalents and reversal of parts.

What is claimed is:

1. Apparatus for detachably connecting a boot to a snowboard, comprising:

first and second connector components, one of which is connected to the boot and the other of which is connected to the snowboard;

said first connector component including a generally vertically oriented ratchet bar having a series of generally vertically spaced apart ratchet teeth;

said second connector component including a receptor for the ratchet bar, said receptor including a releasable ratchet tooth engaging catch that allows movement of the ratchet bar relatively into the receptor in response to a downward movement of the boot;

said receptor having a first position in which the catch engages a ratchet tooth on the ratchet bar to restrain movement of the ratchet bar out from the receptor and movement of the boot away from the snowboard;

said receptor having a second position in which the catch is out of engagement with the ratchet bar and the ratchet bar is movable out from the receptor in response to movement of the boot upwardly away from the snowboard;

wherein the connector component that is connected to the boot moves with the boot towards and away from the snowboard when the boot is moved towards and away from the snowboard; and wherein the connector component that is connected to the snowboard stays with the snowboard when the boot is moved towards and away from the snowboard.

2. Apparatus according to claim 1, wherein the first connector component, the ratchet bar, is connected to the boot and the second connector component, the receptor for the ratchet bar, is connected to the snowboard.

3. Apparatus according to claim 2, further including a upward limiter on the snowboard positioned to extend over a forward portion of the boot, to bind the toe portion of the boot to the snowboard.

4. Apparatus according to claim 1, further including a upward limiter on the snowboard positioned to extend over a forward portion of the boot, to bind the toe portion of the boot to the snowboard.

5. Apparatus according to claim 1, further including a boot holder that is connected to the snowboard for pivotal movement about a vertical axis, and is selectively lockable into a plurality of azimuthal positions on the snowboard, and wherein the connector component that is connected to the snowboard is connected to the boot holder.

6. Apparatus according to claim 5, wherein the first connector component, the ratchet bar, is connected to the heel region of the boot and the second connector component, the receptor for the ratchet bar, is connected to the snowboard.

7. Apparatus according to claim 6, further including a toe strap on the snowboard positioned to extend over a toe portion of the boot, to bind the toe portion of the boot to the snowboard.

8. Apparatus according to claim 5, further including a toe strap on the snowboard positioned to extend over a front portion of the boot, to bind the front portion of the boot to the snowboard.

9. Apparatus according to claim 1, wherein the snowboard includes a step-in boot holder connected to the snowboard and the connector component that is connected to the snowboard is connected to the boot holder.

10. Apparatus according to claim 9, further including a toe strap on the boot holder positioned to extend over a front portion of the boot, to bind the front portion of the boot to the snowboard.

11. Apparatus according to claim 9, wherein the first connector component, the ratchet bar, is connected to the heel region of the boot and the second connector component, the receptor for the ratchet bar, is connected to the boot holder.

12. Apparatus according to claim 10, wherein the first connector component, the ratchet bar, is connected to the heel region of the boot and the second connector component, the receptor for the ratchet bar, is connected to the boot holder.

13. Apparatus according to claim 9, where the ratchet bar includes a sufficient number of ratchet teeth that a tooth of the ratchet bar will be engaged by the catch of the receptor before the boot has bottomed in the step-in boot holder, so that the connector components will be engaged and will connect the boot to the snowboard before the boot has bottomed in the boot holder.

14. Apparatus according to claim 13, further including a toe strap on the snowboard positioned to extend over a toe portion of the boot, to bind the toe portion of the boot to the snowboard.

15. Apparatus according to claim 9, for boot holder connected to the snowboard for pivotal movement about a vertical axis, and is selectively lockable into a plurality of azimuthal positions on the snowboard, and wherein the connector component that is connected to the snowboard is connected to the boot holder.

16. Apparatus according to claim 15, wherein the first connector component, the ratchet bar, is connected to the heel region of the boot and the second connector component, the receptor for the ratchet bar, is connected to the snowboard.

17. Apparatus according to claim 16, further including a toe strap on the snowboard positioned to extend over a toe portion of the boot, to bind the toe portion of the boot to the snowboard.

18. Apparatus according to claim 15, further including a toe strap on the snowboard positioned to extend over a toe portion of the boot, to bind the toe portion of the boot to the snowboard.

19. Apparatus according to claim 1, wherein the first connector component, the ratchet bar, is connected to the snowboard and the second connector component, the receptor for the ratchet bar, is connected to the heel region of the boot.

20. Apparatus according to claim 19, wherein the ratchet bar has a lower end portion that is pivotally connected to a rear portion of a boot holder that is connected to the snowboard, said ratchet bar projecting upwardly from the pivotal connection, whereby the ratchet bar receptor on the boot will engage the ratchet bar above the pivotal connection, and the pivotal connection will allow the ratchet bar to pivot sideways in response to a sideways tilting movement of the boot and ratchet bar receptor.

21. Apparatus according to claim 19, further including a toe strap on the snowboard positioned to extend over a toe portion of the boot, to bind the toe portion of the boot to the snowboard.

22. Apparatus according to claim 19, further including a boot holder that is connected to the snowboard for pivotal movement about a vertical axis, and is selectively lockable into a plurality of azimuthal positions on the snowboard, and wherein the ratchet bar is connected to a rear portion of the boot holder.

* * * * *